United States Patent [19]

Tesch

[11] Patent Number: 4,614,400

[45] Date of Patent: Sep. 30, 1986

[54] WINDING CONTACT WITH ROTARY FASTENING FOR INSERTION INTO A CONTACT HOUSING HOLE WITH CIRCULAR CROSS SECTION

[75] Inventor: Hans-Jürgen Tesch, Oberägeri, Switzerland

[73] Assignee: CDM Connectors Development & Mftg. AG, Cham, Switzerland

[21] Appl. No.: 727,087

[22] Filed: Apr. 25, 1985

Related U.S. Application Data

[63] Continuation of Ser. No. 433,207, Sep. 29, 1982, abandoned.

[30] Foreign Application Priority Data

Feb. 10, 1981 [CH] Switzerland ..... 870/81

[51] Int. Cl.[4] ..... H01R 4/24

[52] U.S. Cl. ..... 339/220 R; 339/221 R; 339/262 R

[58] Field of Search ..... 339/17 C, 220 R, 221 R, 339/221 M, 262 R, 262 F, 262 P, 262 RR, 276 A, 278 T, 252 R

[56] References Cited

U.S. PATENT DOCUMENTS

| | | | |
|---|---|---|---|
| 2,376,625 | 5/1945 | Schmitt | 339/221 M |
| 2,426,845 | 9/1947 | Rogoff | 339/278 T |
| 2,777,118 | 1/1957 | Sundt | 339/221 R |
| 2,871,551 | 2/1959 | Harris | 339/221 R |
| 3,072,880 | 1/1963 | Olsson | 339/221 R |
| 3,288,915 | 11/1966 | Hatfield et al. | 174/94 R |
| 3,371,152 | 2/1968 | Damiano | 339/221 R |
| 3,665,378 | 5/1972 | Hammell et al. | 339/262 R |
| 3,718,895 | 2/1973 | Reynolds et al. | 339/221 R |
| 3,730,972 | 5/1973 | Hennessey | 339/272 A |
| 3,957,337 | 5/1976 | Damiano | 339/221 R |
| 3,975,078 | 8/1976 | Ammon | 339/221 M |
| 4,046,445 | 9/1977 | Anhalt | 339/17 C |
| 4,090,771 | 5/1978 | Moulin | 339/276 A |
| 4,368,944 | 1/1983 | De Young | 339/221 R |

FOREIGN PATENT DOCUMENTS

| | | |
|---|---|---|
| 2616621 | 11/1977 | Fed. Rep. of Germany . |
| 2350775 | 8/1978 | Fed. Rep. of Germany . |
| 2263615 | 10/1975 | France . |
| 908932 | 5/1962 | United Kingdom . |

*Primary Examiner*—Gil Weidenfeld
*Assistant Examiner*—Gary F. Paumen
*Attorney, Agent, or Firm*—Watson, Cole, Grindle & Watson

[57] ABSTRACT

A contact casing (1) rolled from a spring plate blank with a rotary safety zone (30) is present for anchoring and centering of this winding contact in the contact hole of a plastic housing, which rotary safety zone has a centering section (40) encompassing the winding post (3) in the form of a ring and is connected firmly with it and has a clamping section (41). Lateral indentations (34*a*, 34*b*) act as spring elements by which the longitudinal seam (37) of the centering section (40) is held closed in the case of acting torques and radial forces. The clamping section (41) comprises clamping arms (42*a*, 42*b*) which are firmly connected by way of the base part (32) with the centering section (40) and the claws (44*a*, 44*b*) of which project beyond the periphery of the centering section (40). The firm connection of the clamping section (41) and the centering section (40) together with the always closed longitudinal seam (37) of the latter, will ensure that in the case of torques acting on the winding post (3), the claws (44*a*, 44*b*) will only be pressed more firmly into the contact hole wall, but the penetration depth will remain limited to the maximum value predetermined by the projection of the claws (44*a*, 44*b*) beyond the centering section (40). Thus, even in the case of housings made of a soft plastic, a reliable seat of the winding contact and a minimal damage of the contact holes are ensured.

9 Claims, 8 Drawing Figures

WINDING CONTACT WITH ROTARY FASTENING FOR INSERTION INTO A CONTACT HOUSING HOLE WITH CIRCULAR CROSS SECTION

This application is a continuation application of application Ser. No. 433,207, filed Sept. 29, 1982, now abandoned.

BACKGROUND OF THE INVENTION

1. Field of the Invention

The invention relates to a winding contact having a winding post which is attached in a contact casing made of spring plate and carrying a contact element for the centered and torsional holding of the winding contact in a cylindrical contact hole of a contact housing made of electrically insulating plastic.

2. The Prior Art

In the case of electric plug connections with winding contacts in the case of which the wire connection is executed as a nonsoldered connection in the so-called winding or wire wrap technique, it is necessary to absorb with the contact the torque occurring in the case of winding on the winding or wire wrap post, which contact must therefore not rotate in the contact hole of the contact housing. Winding contacts therefore must be equipped with rotary safeties.

A constructionally simple rotary safety will be obtained whenever the contact hole is made non-round in an axial area and whenever the contact is correspondingly constructed. Such a plug connection is described, for example, in the German No. OS 26 16 621. Such a rotary safety necessitates that, for every contact housing, matching contacts be provided, and this contradicts the universality of the contact housing striven for for economic reasons because the usually round contacts cannot be then used.

For the rotary safety of contacts additional parts are frequently used in the most varied embodiments, such as described, for example, in the German patent No. 23 50 775, the U.S. Pat. No. 4,090,771 and in the French Pat. No. 2,263,615. The separate anchoring part will be attached frequently to the contact or it is placed over the winding post and may consist of a lamella or a peg. Bipartite rotary-secured contacts are expensive in their production and uneconomical, and moreover their handling is cumbersome, whereby considerable wear and tear often occurs on the contact housing since, during the replacement of the contacts, the walls for the contact hole may easily be greatly damaged, or as especially in the case of multiple contacts with a multiplicity of contacts arranged closely beside one another, they could even be destroyed.

In the market place, one-part rotary-secured contacts are available in which the essentially casing-shaped resilient rotary safety is made of the same piece of material as the contact body. Known embodiments of such single rotary-secured contacts however turn out to be unsatisfactory insofar as above all, because of a resilient springiness of the springy rotary safety and of the circumstance that stronger torques and radial forces acting upon the contact inserted into a contact hole, lead to changes of diameter in the case of the rotary safety and/or to a reduction of the penetrating depth of the clamping elements in the wall of the contact hole, only relatively weak torques must be applied for the production of a winding contact, in order to exclude with assurance a loosening of the rotary safety in the case of winding, and thus one must count with a more frequent occurrence of defective electrical connections subject to breakdowns between the conducting wire and the contact piece.

Therefore, it was the task of the invention to create a rotatably secured winding contact of the initially mentioned type in the case of which and on the assumption that, whenever it is inserted into a contact hole with a circular cross section, it will permit the essentially desirable mobility of the contact piece in the contact hole for plug connections and at the same time center the plug connection area as well as the winding post well, that the rotary safety is unchangeably reliable even after frequent contact loads, as they occur especially in the case of plugging connections themselves or in the case of a pull on the connected conducting wire, and in the case of which torques and radially acting forces will not change the penetrating depth of anchoring elements in the wall of the contact hole disadvantageously. Furthermore, the exchangeability is to be ensured for the winding contact, that is to say, the winding contact should be such that upon taking the contact housing from the contact hole, the wall of the contact hole will not be destroyed or damaged so badly that it no longer satisfies the electric requirements, especially with regard to the insulation thickness, and finally, the winding contact is to be producible also in an economic mass production.

SUMMARY OF THE INVENTION

According to the invention the rotary safety of the winding contact is guaranteed solely by a special development of a relatively narrow section of the contact casing at the end far away from the contact element, whereby for the winding pole there only exists the requirement that it be firmly mechanically connected with this rotary safety zone, otherwise however, all possibilities are left open for the winding post and for the development of the contact element, be that as a plug connection or as a peg. The clamping together of the rotary safety zone at two points in the contact hole which face each other ensures the desired mobility of the contact element in the contact hole, and torques as well as radially acting forces do not tend to a reduction of the diameter in the centering section of the rotary safety zone but to an enlargement of the diameter, which ensures a firm seat of the contact casing in the contact hole and thus a good centering of the contact piece and winding post. The penetrating depth of the claws in the wall of the contact hole, limited in any case to a predetermined maximum value, make the winding contact according to the invention usable for contact housings of any kind of plastic, so that the contact housing may consist especially also of a soft plastic, such as a thermoplastic. As a result of the limited penetrating depth, there is no need to fear a stronger damage of the wall of the contact hole even when removing the winding contact from a contact hole, so that the exchangeability is ensured and in the case of exchanging a contact, it will only be necessary for the new winding contact to be displaced in the contact hole somewhat as compared to the original position, in order to obtain optimum conditions. The contact casing may be mass-produced easily by a pipeshaped rolling up of spring plate blanks.

In the following description, the invention will be explained in more detail on the basis of a preferred embodiment with reference to the attached drawing:

DETAILED DESCRIPTION OF THE PREFERRED EMBODIMENT

Figure 1:
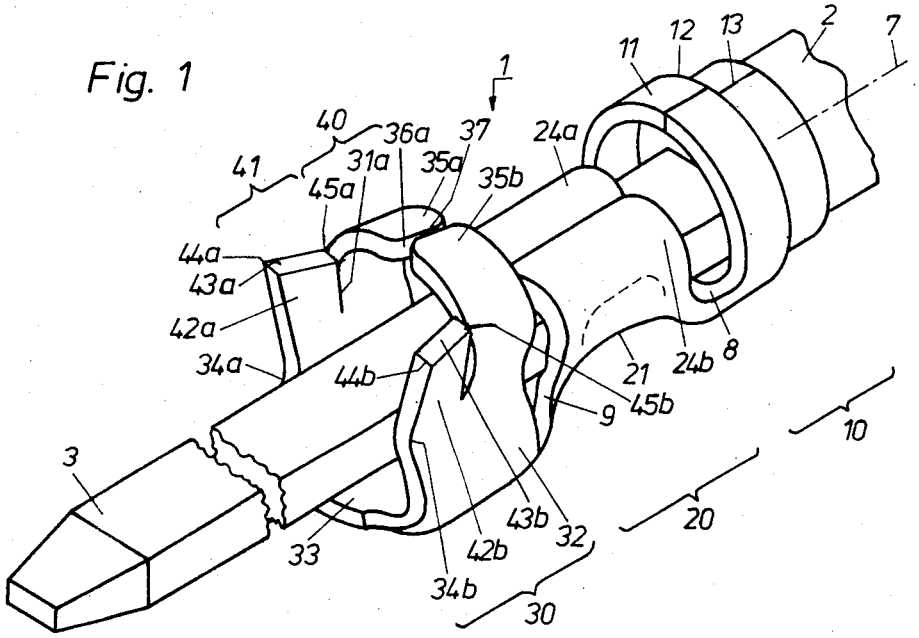
FIG. 1 shows in perspective presentation a winding contact according to the invention with a clamping and a centering section in the rotary safety zone of the contact casing.

The winding contact shown in FIG. 1, a so-called wire-wrap contact, has a contact casing 1 which is rolled in the manner of a pipe from a spring plate blank 1' (FIG. 5) and which carries at one end a plug connector or a plug peg as a contact element 2 away from which right through the contact casing 1, a coaxial winding post 3 extends. The winding post 3 existing for the winding contact (wire-wrap-connection) may have a rectangular cross section (FIG. 1) of, for example, 0.8 mm×1.6 mm or else a square cross section (FIG. 2, FIG. 3) of, for example, 1 mm×1 mm. Contact casing 1, contact element 2 and winding post 3 consist of materials customary for such electric plug connections, the contact casing for example consists of bronze sheet. The winding contact is plugged into a cylindrical contact hole 5 of an electrically insulating housing 4 (FIG. 2, FIG. 3) made of plastic, for example, of a phenoplast or a thermoplast, whereby the outside areas of the contact casing 1 fit against the wall 6 of the contact hole and the winding contact is centered by way of the contact casing 1 in the contact hole 5 and secured against turning around the longitudinal axis 7, non-shiftable in longitudinal direction and it is supposed to be somewhat moveable in order to facilitate the plugging together in the plugging area, which in the case of the winding contact according to the invention will be achieved by a special shaping of the contact casing 1 which will be described in more detail in the following paragraphs with reference to the FIGS. 1 and 4.

Figure 4:
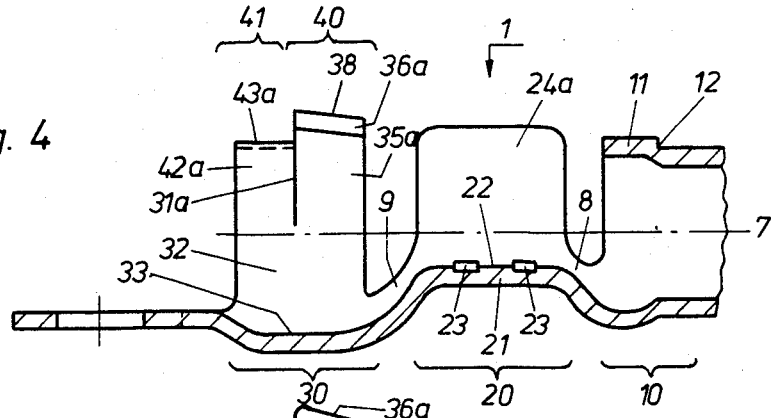
FIG. 4 shows a longitudinal section through the contact casing of the winding contact.

As is shown in the FIGS. 1 and 4, the contact casing 1 essentially has three zones, the contact piece-carrier zone 10, the winding post-carrier zone 20 and the rotary safety zone 30 which are separated from one another by connecting bridges 8, 9 leaving radial recesses, whereby the connecting bridges 8, 9 lie one behind the other in a longitudinal direction of the casing 1 and every connecting bridge 8 or 9 extends over about 75° of the casing periphery.

In the contact element-carrier zone 10, the contact casing 1 is developed as an essentially cylindrical ring 11 which is graduated in order to form a projecting shoulder 12 in the direction toward the contact element 2, whereby the smaller outside diameter of the stepped ring 11 is not smaller than the diameter of the contact element 2. In the case of a winding contact inserted into a contact hole, the contact piece-carrier zone 10 is located in a corresponding constriction of the hole against which, as is customary in the case of plug connections, the shoulder 12 abuts in order to prevent a pulling out of the winding contact in case of disengagement of the plug connection which, however, permits a certain freedom of movement in radial direction for the contact element-carrier zone 10 of the contact casing 1 in order to facilitate the plugging together of the plug connection.

In the winding post-carrier zone 20, the contact casing 1 is placed between the two connecting bridges 8 and 9 and forms a bearing block 21 for the winding post 3 with a flat supporting surface 22 (FIG. 4) which lies so far in the inside of the casing that the winding post 3 placed on it is coaxial with the stepped ring 11 of the contact element-carrier zone 10 and the contact element 2 itself. Effectively, transverse grooves 23 are provided in the supporting surface 22, in which projections of the winding post 3 engage in order to better secure the winding post against longitudinal shifting. On the support-surface 22, the winding post 3 is attached in such a way that torques acting upon it are transferred to the contact casing 1. For this purpose, flaps 24*a*, 24*b* protruding laterally from the bearing block 21 shown by way of example in the embodiment are provided, which flaps are bent around the put on winding post 3 and hold the latter firmly against the bearing block 21 of the contact casing 1 in a crimp connection.

Figure 3:
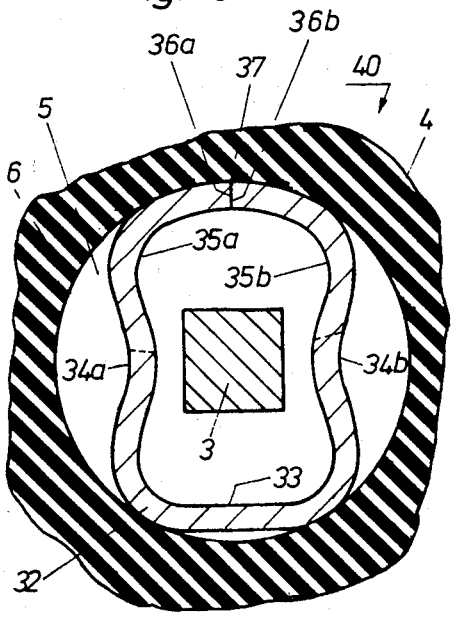
FIG. 3 shows a cross section of the winding contact of FIG. 1 in the area of the centering section of the contact casing.

In the rotary safety zone 30, following the connecting bridge 9, the contact casing 1 in the upper half of the casing in relation to the connecting bridge 9 at the end of the casing has a crimping section 41 and a centering section 40 following the former in an inward direction, which sections are separated from one another by an incision 31*a* and which have a lower half of the rotary safety zone 30 connecting with the connecting bridge 9 as a common base part 32. The centering section 40 is made up by two centering flaps 35*a*, 35*b* starting out laterally from the base part 32 which are bent together and which abut on the longitudinal joint 37 in order to form with the base part 32 of the rotary safety zone 30 a winding ring encircling the winding post 3 at a distance, which ring fits into a contact hole 5 (FIG. 3) of the housing 4. In the area of the centering section 40, the contact casing 1 in its cross section has approximately the shape of a bent in oval or of an open eight, as is shown in FIG. 3. The base part 32 has a flat bottom 33 which passes over into the connecting bridge 9 and the two lateral wave-shaped, flared indentations 34*a*, 34*b* lie partly in the base part 32 and for the other part in the two centering flaps 35*a*, 35*b*, the free ends of which 36*a*, 36*b* abut against each other on the longitudinal joint 37. The centering section 40 of the rotary safety zone 30 has the task of balancing out tolerances of the contact hole 5 in the housing 4 and to keep the inserted winding contact centered in the contat hole 5, whereby the indentations 34*a*, 34*b* act as spring elements and keep the longitudinal seam 37 closed. For an easy insertion of the contact casing 1, into a contact hole 5, the centering section 40 is developed conically preferably in the area of the longitudinal seam 37, as shown in FIG. 4 at 38.

The clamping section 41 of the rotary safety zone 30 comprises two clamping arms 42*a*, 42*b* projecting upwards from the base part 32, which are separated from the centering flaps 35*a*, 35*b* by the incisions 31*a*, 31*b* and are shorter than the latter. The clamping arms 42*a*, 42*b* are directed upwards away from the deepest points of the indentations 34*a*, 34*b* from the bottom 33 of the base part 32 and transversely toward the outside (FIG. 2) and at their narrow sides 43*a*, 43*b* they have sharp edges forming corners. In the case of each clamping arm 42*a*, 42*b*, the outside corner farther from the centering section 40 serves as a clamp 44*a* or 44*b*, whereby the clamping arms 42*a*, 42*b* in addition are twisted in such a way that the clamps 44*a*, 44*b* project beyond the outside periphery of the centering section 40, the outside corners 45*a*, 45*b* close to the centering section 40 however lie within it, so that these corners 45*a*, 45*b* form no resistance in the case of insertion of the contact casing 1 into a contact hole 5 (FIG. 2) and only the clamps 44*a*, 44*b* are forced into the perforated wall 6.

Figure 2:
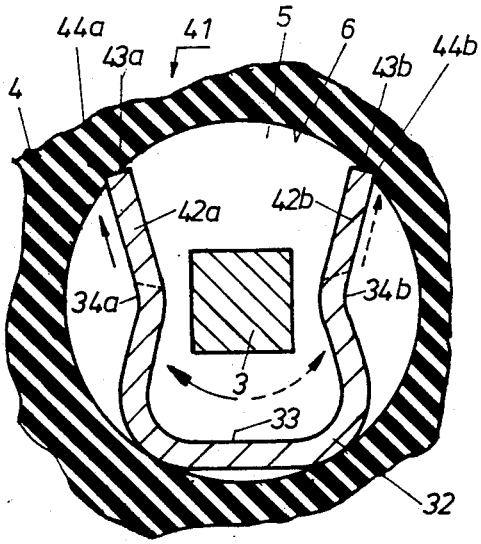
FIG. 2 shows a cross section of the winding contact of FIG. 1 in the area of the clamping section.

During the insertion of the winding contact into a contact hole, the centering section 40 in the rotary safety zone 30 is compressed by the conic surface 38 (FIG. 4) gliding on the perforated edge of the hole, so that, as can be seen from the cross section of FIG. 3, the longitudinal seam 37 is closed and the centering section 40 is forced against the wall 6 of the hole of the contact hole 5 firmly by the tension of the indentations 34*a*, 34*b* acting as spring elements at the two narrow sides, that is to say in the area of both sides of the longitudinal seam 37 and in the area of the bottom 33 of the base part 32, and furthermore the clamps 44*a* and 44*b* projecting laterally beyond the periphery of the centering section 40, as shown in FIG. 2, are pressed more or less deeply into the wall of the hole depending on the hardness of the housing material. The contact casing 1 anchored in such a manner at two points in the contact hole 6 by the two clamps 44*a*, 44*b* of the clamping section 41 ensures a firm seat of the winding contact in the contact hole 6, whereby the winding post 3 is centered in the contact hole 6 and the longitudinal seam 37 of the centering section 40 remains closed even whenever in the case of producing or detaching of a plug connection, the contact casing 1 is moved somewhat laterally in radial direction in the area of the contact element-carrier zone 10 (FIG. 1) since such small lateral movements practically have no influence on the centering section 40 and on the clamping in the clamping zone 41 in the case of the distance of the rotary safety zone 30 from the contact element-carrier zone 10.

Whenever in the case of making a winding contact, a torque is exerted on the contact element 2 or on the winding post 3, then it is transmitted by way of the heating block 21 (FIG. 1) of the winding post-carrier zone 20 and the subsequent connecting bridge 9 to the base part 32 of the rotary safety zone 30, which base part is in common to the centering section 40 and the clamping section 41. In the case of the centering section 40 (FIG. 3), a torque tends to widen the longitudinal seam 37 and the enlargement of the periphery of the contact casing 1 in this area to be sure, but as a result of the resilient action of the indentations 34*a*, 34*b* and as a result of the perforated wall 6, this tendency is blocked, so that the longitudinal seam 37 will always remain closed and the centering section 40 will also not spread apart in the area of the longitudinal seam 37. In the case of the clamping section 41 (FIG. 2), a clockwise torque (solid arrows) brings about that the clamp 44*a* of the in FIG. 2 left-hand clamping arm 42*a* will be more strongly forced into the perforated wall 6 and a corresponding effect shows a torque counterclockwise (broken arrows) in the case of the in FIG. 2 right-hand clamping arm 42*b*. Because of the mechanically solid connection of the clamping arms 42*a*, 42*b* with the centering section 40 and its always closed longitudinal seam 37, the penetrating depth of the clamps 44*a*, 44*b* is limited to the maximum value given as a result of the projection of the clamps 44*a*, 44*b* beyond the periphery of the centering section 40, so that even in the case of a housing 4 consisting of a soft plastic, for example, a thermoplast, the clamps 44*a*, 44*b* could not be pressed into the hole of the wall 6 beyond this maximum penetrating depth and thus even in the case of a repeated insertion of a winding contact into the contact hole 5, only a slight damage of the contact hole wall 6 is ensured.

Figure 5:
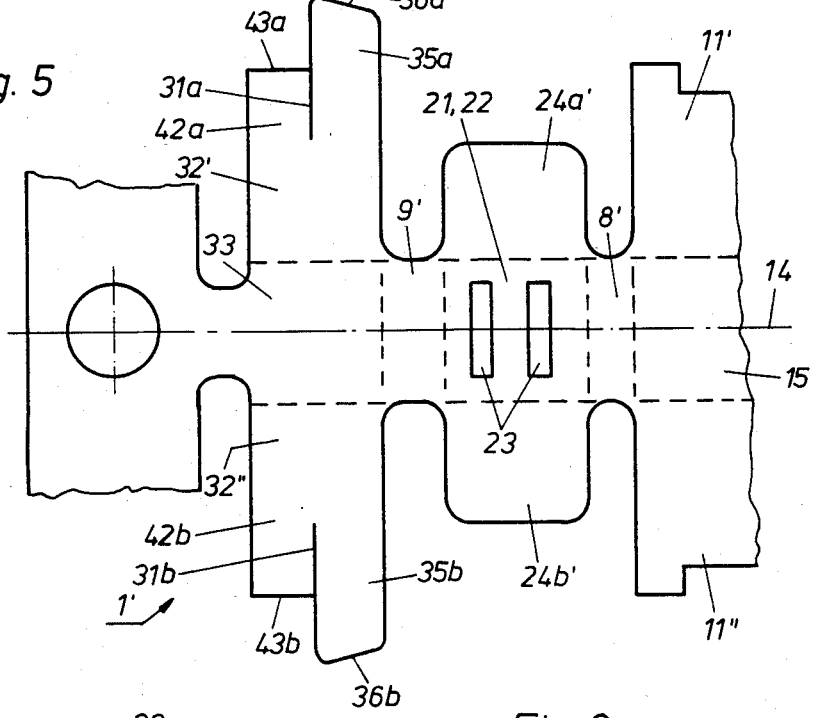
FIG. 5 shows an upright projection of a spring plate blank for the production of the contact casing of FIG. 4
Figure 6:
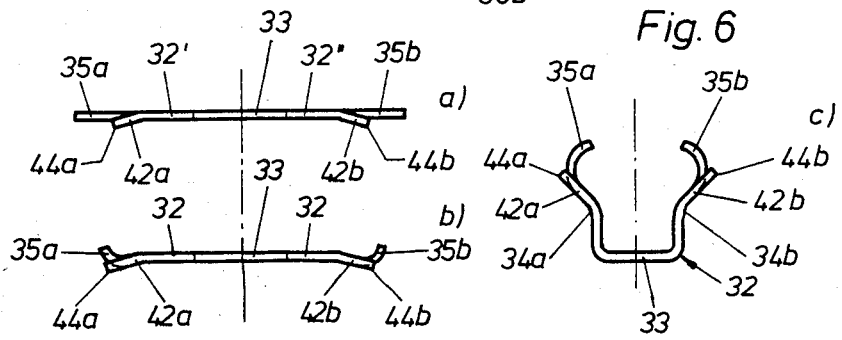
FIG. 6 shows in schematic presentation three bending steps (a), (b) and (c) in the case of forming the rotary safety zone of the contact casing from the corresponding area of the spring plate blank of FIG. 5.

FIG. 5 shows a preferred spring plate blank 1' for the production of the previously described contact casing 1. The blank 1' which is symmetrical in relation to a center line 14, has in the area of the three zones 10, 20, 30 a strip-shaped middle area 15 in the width of the bearing block 21 from which at both longitudinal sides at one end, flaps 11', 11'' start off for the formation of the stepped ring 11 (FIG. 1) of the contact element-carrier zone 10, in the middle flaps 24*a'*, 24*b'* for the squeeze or crimping flaps 24*a*, 24*b* of the bearing block 22 and following that, flaps 32', 32'' for the formation of the two sides of the base part 32 of the rotary safety zone 30 with the centering flaps 35*a*, 35*b* separated from one another by transverse incisions 31*a*, 31*b* and clamping arms 42*a*, 42*b*. The centering flaps 35*a*, 35*b* have slanting narrow sides 36*a*, 36*b* for the formation of the conical area 38 (FIG. 4) and the clamping arms 42*a*, 42*b* have narrow dies 43*a*, 43*b*, preferably parallel to the center line. The strip-shaped, middle area 15, as is clear from FIG. 4, is bent along the center line 14 in such a way that in the case of the contact casing 1, in the contact element-carrier zone 10, the radii of the stepped ring 11 result, in the winding post-carrier zone 20, the bearing block 21 results, and in the rotary safety zone 10, the bottom 33 of the base part 32. The flaps 11' and 11'' are bent in the shape of a circular arch with adjacent narrow sides so that the stepped ring 11 with the longitudinal seam 13 (FIG. 1) will result, the flaps 24*a'* and 24*b'* are bent U-shape in order to facilitate the making of the squeezing or crimp connection after placing the winding post 3 onto the bearing block 22 and the flaps 32' and 32'' with the centering flaps 35*a*, 35*b* and the clamping arms 42*a*, 42*b* are bent into the shape provided for the rotary safety zone 30. FIG. 6 shows three steps of a bending process possible for the formation of the rotary safety zone 30.

In order to maintain the rotary safety zone 30 in the form described above, the clamping arms 42*a* and 42*b* are bent downwards in the case of a flat spring plate blank 1' in a first bending step (FIG. 6*a*) in such a way for example, that the lower corners distant from the incisions 31*a*, 31*b* (FIG. 5) forming the clamps 44*a* and 44*b* project beyond the underside of the blank, the corners close to the incisions 31*a*, 31*b* however, remain at the sectional areas. In a second bending step (FIG. 6*b*), the centering flaps 35*a* and 35*b* are arched and in a third bending step (FIG. 6*c*), the flaps 32' and 32'' are bent upwards in order to form the bottom 33 of the base part 32 and are bent laterally outwards, in order to maintain the indentations 34*a* and 34*b*. Such a production of the contact casing 1 from spring plate blanks 1' is best suited for an economic mass production.

With the previously described contact casings 1, the winding contacts can be mounted easily and inserted into contact holes, whereby a reliable seat of the winding contact in the contact hole will be guaranteed.

I claim:

1. A winding contact element which can be securely positioned in a cylindrical hole of a contact housing made of an electrically-insulating plastic material, said winding contact element including an elongated contact casing made of flexible metal and a winding post extending therewithin, said contact casing defining a hollow safety section at one end thereof, said hollow safety section including a base;

opposite side walls extending upwardly from said base, said side walls curving towards one another to respective flared indentation lines;

a centering flap and a separate clamping arm extending upwardly from each opposite side wall, each centering flap and each clamping arm defining opposite side edges and a top edge, the centering flaps extending upwardly from the respective flared indentation lines to first curve gradually away from one another and then curve towards one another so as to define a longitudinal joint between the top edges thereof, the external surfaces of said centering flaps adjacent said longitudinal joint forming a conic surface whose diameter increases in the axial direction towards said clamping arms; said clamping arms extending upwardly from the respective flared indentation lines to curve away from one another such that first corners of said respective clamping arms, which corners are located at the intersection of the top edges and the side edges nearest the adjacent centering flaps, are located closer to one another than the second corners thereof, which are located at the intersection of the top edges and the side edges furthest from the adjacent centering flaps, said second corners being normally located outside the maximum periphery associated with said conic surface defined by said external surfaces of said centering flaps;

said longitudinal joint between the top edges of said centering flaps becoming closed as the conic surfaces thereof are contacted by the cylindrical hole of the contact housing as the winding contact is gradually inserted in the cylindrical hole, said flared indentation lines concurrently being resiliently moved towards one another, said movement causing the second corners of said clamping arms to resiliently move towards one another, thus enabling said winding contact to be fully inserted in said cylindrical hole with a minimum of damage to said hole by the second corners of said clamping arms, said clamping arms thereafter preventing said winding contact from being rotated within said cylindrical hole due to abutment of the second corners thereof against the wall of said cylindrical hole.

2. The winding contact element as defined in claim 1, wherein said clamping arms are formed as bent rectangles.

3. The winding contact element as defined in claim 1, wherein the first corners of said respective clamping arms are normally located within the maximum periphery associated with the conic surface defined in said external surfaces of said centering flaps.

4. The winding contact element as defined in claim 1, wherein said contact casing defines a winding post-carrier section axially inwardly of said hollow safety section, said contact casing defining a bearing block in said post-carrier section upon which said winding post is fixedly mounted so as to coaxially extend through said hollow safety section.

5. The winding contact element as defined in claim 4, wherein said contact casing defines a curved connecting bridge between said winding post-carrier section and said hollow safety section.

6. The winding contact element as defined in claim 5, wherein said contact casing defines flaps in said winding post-carrier zone which extend laterally around said bearing block and are crimped over to fixedly position said winding post on said bearing block.

7. The winding contact element as defined in claim 6, wherein said contact casing defines a hollow contact element-carrier section at the second end thereof, said contact casing defining a stepped cylindrical ring in said hollow contact element-carrier section which is coaxial with the winding post which extends therethrough.

8. The winding contact element as defined in claim 7, wherein said contact casing defines a curved connecting bridge between said hollow contact element-carrier section and said winding post-carrier section.

9. The winding contact element as defined in claim 1, wherein said contact casing is made from a pipeshaped, rolled spring plate blank.

* * * * *